United States Patent [19]

Merz

[11] 4,385,870

[45] May 31, 1983

[54] RADIAL PISTON PUMP

[75] Inventor: Johann Merz, Bopfingen, Fed. Rep. of Germany

[73] Assignee: Zahnradfabrik Friedrichshafen, AG., Friedrichshafen, Fed. Rep. of Germany

[21] Appl. No.: 235,594

[22] Filed: Feb. 18, 1981

[30] Foreign Application Priority Data

Mar. 6, 1980 [DE] Fed. Rep. of Germany ..... 3008575

[51] Int. Cl.[3] ..... F04B 1/04

[52] U.S. Cl. ..... 417/273

[58] Field of Search ..... 417/273, 489, 490, 557; 92/246

[56] References Cited

U.S. PATENT DOCUMENTS

| | | | |
|---|---|---|---|
| 1,478,561 | 12/1923 | Faessel | 92/246 |
| 2,345,125 | 3/1944 | Huber | 417/273 |
| 2,818,816 | 1/1958 | Christenson | 417/273 |
| 3,128,718 | 4/1964 | Rhodes et al. | 92/246 |
| 3,153,385 | 10/1964 | Bowen, Jr. | 417/489 |

FOREIGN PATENT DOCUMENTS

| | | | |
|---|---|---|---|
| 2425022 | 4/1975 | Fed. Rep. of Germany | 417/273 |
| 1390520 | 4/1975 | United Kingdom | 417/273 |

*Primary Examiner*—William L. Freeh

*Attorney, Agent, or Firm*—Zalkind & Shuster

[57] ABSTRACT

A fluid pressure zone is established within the piston bore of a top-loading type of radial piston pump, in opposing relation to the intake passage intersecting the bore to take up radial clearance between the piston and a sealing surface portion of the bore between the intake passage and the pressure chamber into which fluid is displaced by the piston.

7 Claims, 5 Drawing Figures

RADIAL PISTON PUMP

BACKGROUND OF THE INVENTION

This invention relates in general to radial piston pumps of the so-called top loading type.

A top loading type of radial piston pump is disclosed, for example, in German Patent No. OS 22 42 435. In pumps of the foregoing type, an inflow of fluid is received within a fluid displacing piston at its radially outer end remote from the drive cam with which the piston is engaged for reciprocation. Inflow of fluid is conducted to the piston through an intake passage which is closed off during the fluid displacing stroke of the piston. The fluid displaced by the piston is conducted to an outlet pressure line through a check valve from which the fluid is then conducted to a fluid operated device. During the fluid displacing stroke, the radially outer end portion of the piston moves across a relatively short sealing surface portion of the piston bore within which the piston is reciprocated, such sealing surface portion being located radially outward of the inlet passage. A slight overlap between the inlet passage and the piston is often the cause of fluid leakage loss during the fluid displacing stroke of the piston.

It is therefore an important object of the present invention to minimize fluid leakage past the fluid displacing piston at the shortest sealing surface portion between the inlet passage and the pressure chamber into which the fluid is displaced in a radial piston pump of the top loading type.

SUMMARY OF THE INVENTION

In accordance with the present invention, a radial piston pump of the top loading type is provided with a pressure zone acting laterally on the fluid displacing piston along the short sealing surface portion of the piston bore between the intake passage and the piston pressure chamber. The pressure zone may be confined to a blind bore section formed on one side of the piston bore opposite the side from which the intake passage extends, the intake passage being formed on said other side of the piston bore by an inlet bore which intersects the piston bore to form the blind bore section. A connecting passage establishes fluid communication between the blind bore section and the pressure chamber for pressurization of the pressure zone during the compression phase of the piston stroke.

According to an alternative arrangement, the pressure zone aforementioned may be formed within a one-sided shouldered recess in the piston bore opposing the intake passage. Further, the radially inner end of the piston in sliding contact with the piston operating cam, is beveled and a resilient skirt is mounted on the piston at its radially outer end in slide bearing relation to the short sealing surface portion of the piston bore.

By virtue of the foregoing arrangements of the present invention, a transverse fluid pressure force is produced at the pressure zone in order to reduce lateral piston play adjacent the intake passage. In this fashion, fluid leakage is minimized and the effectiveness of the radial piston pump may be considerably improved.

The present invention is particularly advantageous for radial piston pumps having parts constructed of materials with different thermal expansion coefficients. For example, the pump housing may be made of a relatively light weight metal in order to reduce the total weight of the pump while the piston is made of steel that thermally expands at a rate much lower of that of the light weight pump housing. In such case, the lateral play of the piston within its bore is increased together with the amount of fluid leakage. The leakage reducing feature of the present invention therefore enables one to construct a pump from materials having different thermal expansion coefficients despite the fluid leakage problem associated therewith.

BRIEF DESCRIPTION OF DRAWING FIGURES

The invention will be hereinafter described in greater detail with respect to various embodiments illustrated by way of example in the accompanying drawing, wherein.

DETAILED DESCRIPTION OF PREFERRED EMBODIMENTS

Figure 1:
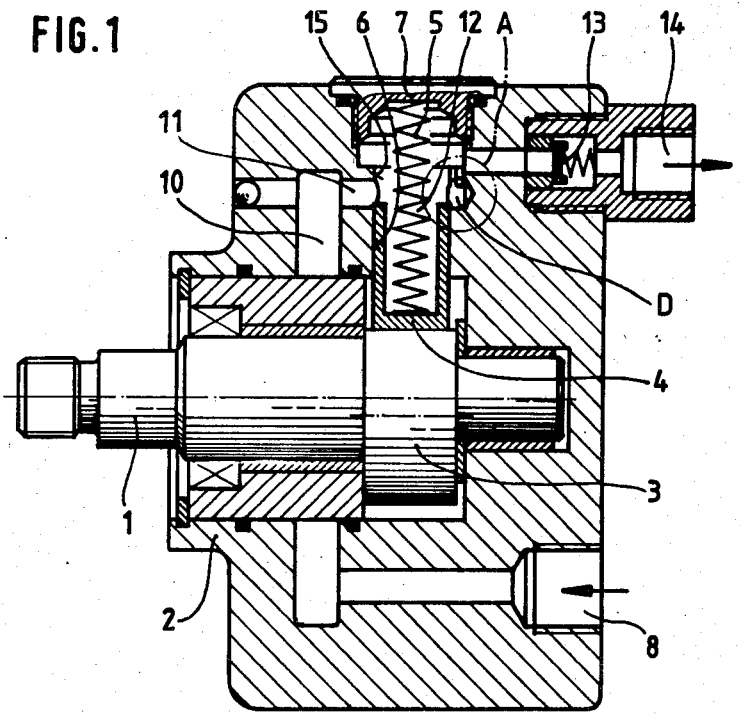
FIG. 1 is a longitudinal section view through a radial piston pump constructed in accordance with the present invention.

Referring now to the drawings in detail, FIG. 1 illustrates a radial piston pump of the top-loading type with which the present invention is associated. The pump includes a drive shaft 1 rotatably mounted within a pump housing 2 for rotation of a cam 3 about a rotational axis fixed in the housing. The cam 3 operates a fluid displacing piston 4 which is held in contact with the peripheral surface of the cam by a compression spring 5. Radial movement of the piston 4 in response to rotation of cam 3 is guided by a piston bore 6 within which the piston is mounted, the bore 6 being closed at its radially outer end by a screw cap 7. A fluid reservoir tank (not shown) supplies fluid to an intake connection 8 from which the fluid is conducted to an annular chamber 10 formed within the pump housing. The annular chamber 10 is in fluid communication with the piston bore 6 by means of an inlet bore 11. The fluid displacing piston 4 separates a pressure chamber 12 from the inlet bore 11 and in response to its displacement by the cam 3 displaces fluid through a check valve 13 to an outlet connection 14 connected to a fluid operated device (not shown). The foregoing description of the radial piston pump arrangement is already known in the art.

Figure 2:
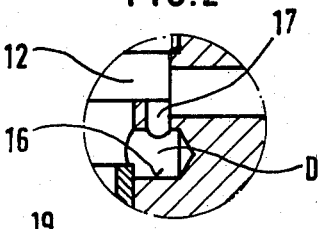
FIG. 2 is an enlarged section view of a portion of the pump construction shown in FIG. 1 in accordance with one embodiment of the invention relating to the pressure zone.

In accordance with the present invention, a fluid pressure zone D is formed at a location within the piston bore 6 opposing a sealing surface portion 15 between the pressure chamber 12 and the inlet bore 11. As shown in FIG. 2, the pressure zone D is formed within a blind bore section 16 resulting from the extension of the inlet bore 11 completely through the cylinder bore 6. The blind bore section 16 is in continuous fluid communication with the pressure chamber 12 through a small connecting bore or passage 17. During movement of the piston 4 in a radially outer fluid displacing direction, it passes beyond the inlet bore 11 to compress fluid displaced by such movement within the pressure chamber 12. At the same time, pressurized fluid within the pressure chamber 12 is conducted to the pressure zone D within the blind bore section 16 through the passage 17. As a result, a transverse pressure force is exerted by the pressurized fluid in the pressure zone on the fluid displacing piston 4 tending to laterally displace the radially outer end of the piston to take up any radial clearance or lateral play between the piston and the short sealing surface portion 15. Tilting of the piston 4 where it contacts the radial cam surface of cam 3 is prevented by the pressure force of the fluid in pressure chamber 12 maintaining pressurized contact between the piston 4 and the cam. Thus, the amount of leakage fluid that heretofore returns to the inlet fore 11 along the sealing surface piston 15 is minimized. In order to improve the sealing action below the pressure zone D, sealing grooves (not shown) may be formed in the external surface of the piston 4 in accordance with an already well known piston sealing technique.

Figure 3:
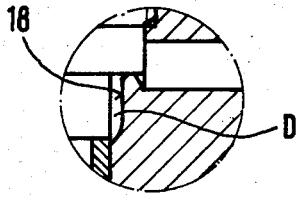
FIG. 3 is an enlarged partial section view similar to that of FIG. 2 but showing another embodiment with respect to the pressure zone.

Another embodiment of the invention is illustrated in FIG. 3 wherein the pressure zone D is formed within a one-sided shouldered recess 18 in the piston bore surface located opposite the inlet bore 11. In this embodiment, the inlet bore terminates at its intersection with the piston bore 6 and does not extend therebeyond as in the case of the embodiment shown in FIG. 2.

Figure 4:
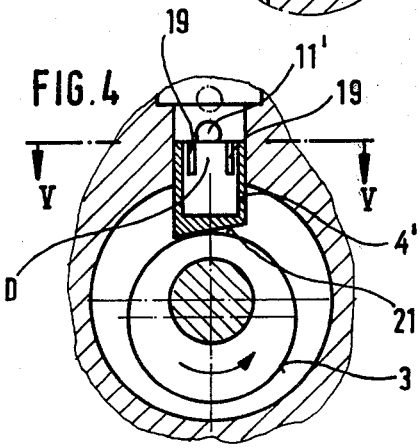
FIG. 4 is a partial transverse section view of a portion of the radial piston pump in accordance with a third embodiment of the invention.
Figure 5:
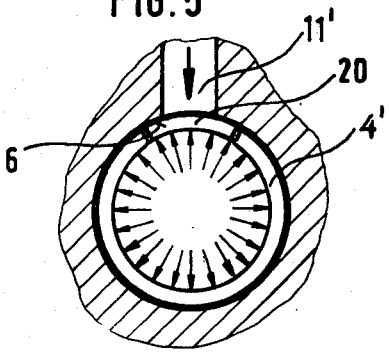
FIG. 5 is an enlarged partial section view taken substantially through a plane indicated by section line V—V in FIG. 4.

FIGS. 4 and 5 illustrate yet another embodiment of the invention wherein a fluid displacing piston 4' has a pressure zone D associated therewith in the area of an inlet bore 11', the piston being provided with two slits 19 through which it supports a resilient skirt 20. During a pressure displacing stroke of the piston 4', the piston skirt 20 is urged outwardly against the walls of the piston bore 6 by internal pressure. Lateral piston play in the area of the inlet bore may thereby reduce considerably. In order to prevent angular displacement of the piston 4', the radially inner contact end thereof engageable by the cam 3, is provided with a beveled surface 21.

The invention as hereinbefore described is, of course, not limited to the specific embodiments shown by way of example, but may be applied to similar pumps including those with several fluid displacing pistons.

What is claimed is:

1. In a radial piston pump having a piston (4) undergoing a fluid displacing stroke against a spring bias in a piston bore (6) formed in a pump housing (2) within which an intake passage (11) is formed from which fluid is displaced by the piston into a pressure chamber (12) and discharged therefrom during a compression phase of the stroke through a check valve (13), the improvement residing in means for minimizing fluid leakage along a sealing surface portion (15) in the piston bore between the intake passage and the pressure chamber, including a fluid pressure zone (D) sealed from the intake passage by the piston during the compression phase and to which the piston is exposed within the bore in opposing relation to the intake passage, and means for pressurizing said pressure zone during the compression phase to take up radial play between the piston and the sealing surface portion.

2. The improvement as defined in claim 1 wherein said pressure zone is formed by a blind bore section (16) of an inlet bore intersecting the piston bore to establish the intake passage on one side of the piston bore, said pressurizing means comprising a connecting passage (17) establishing continuous fluid communication between the blind bore section and the pressure chamber.

3. The improvement as defined in claim 1 wherein said pressure zone is formed by a one-sided, shouldered recess (18) in the piston bore.

4. The improvement as defined in claim 1 including a beveled contact surface (21) formed on a radially inner end of the piston, a cam (3) in engagement with said surface, and a resilient skirt (20) mounted on the piston in slide bearing relation to said sealing surface portion of the piston bore.

5. In combination with a radial piston pump having a housing (2) formed with a piston bore (6), an inlet passage (11) intersecting said bore and a pressure chamber (12), and a piston (4) reciprocally mounted within the bore to displace fluid from the inlet passage to the pressure chamber, said bore being formed with a sealing surface portion (15) between the inlet passage and the pressure chamber, the improvement residing in means for minimizing radial play between the piston and said sealing surface portion of the bore during compression of fluid in the pressure chamber by the piston to reduce fluid leakage, comprising fluid pressure means laterally acting on the piston during said compression of the fluid for take-up of said radial play.

6. The improvement as defined in claim 5 wherein said fluid pressure means comprises a resilient skirt (20) mounted on the piston.

7. In combination with a radial piston pump having a housing (2) formed with a piston bore (6), an inlet passage (11) intersecting said bore and a pressure chamber (12), and a piston (4) reciprocally mounted within the bore to displace fluid from the inlet passage to the pressure chamber, said bore being formed with a sealing surface portion (15) between the inlet passage and the pressure chamer, the improvment residing in means for minimizing radial play between the piston and said sealing surface portion of the bore to reduce fluid leakage, comprising fluid pressure means laterally acting on the piston during movement thereof in a fluid displacing direction for take-up of said radial play, said fluid pressure means comprising a fluid pressure zone (D) in fluid communication with the pressure chamber established in the piston bore in opposing relation to the inlet passage.

* * * * *